US008612115B2

(12) United States Patent
George et al.

(10) Patent No.: US 8,612,115 B2
(45) Date of Patent: Dec. 17, 2013

(54) METHODS FOR CONTROLLING THE OPERATION OF A PARTICULATE FILTER

(75) Inventors: Sam George, Painted Post, NY (US); Suhao He, Painted Post, NY (US); Achim Karl-Erich Heibel, Corning, NY (US)

(73) Assignee: Corning Incorporated, Corning, NY (US)

( * ) Notice: Subject to any disclaimer, the term of this patent is extended or adjusted under 35 U.S.C. 154(b) by 779 days.

(21) Appl. No.: 12/871,474

(22) Filed: Aug. 30, 2010

(65) Prior Publication Data

US 2012/0053814 A1 Mar. 1, 2012

(51) Int. Cl.
*F01N 3/023* (2006.01)
*F02D 28/00* (2006.01)

(52) U.S. Cl.
USPC ..... 701/102; 60/295

(58) Field of Classification Search
USPC ..... 701/102; 60/274, 276, 285, 286, 295, 60/311
See application file for complete search history.

(56) References Cited

U.S. PATENT DOCUMENTS

| | | | | |
|---|---|---|---|---|
| 4,633,706 | A | 1/1987 | Ito et al. | |
| 5,546,788 | A | 8/1996 | Dickow | |
| 6,148,656 | A | 11/2000 | Breton | |
| 6,796,165 | B2 | 9/2004 | Abdul-Khalek | |
| 8,069,658 | B2 * | 12/2011 | He et al. | 60/295 |
| 8,464,520 | B2 * | 6/2013 | Chen et al. | 60/274 |
| 2008/0155964 | A1 | 7/2008 | Kilkenny | |
| 2010/0077727 | A1 | 4/2010 | Southward et al. | |
| 2010/0126145 | A1 | 5/2010 | He et al. | 60/286 |

FOREIGN PATENT DOCUMENTS

| | | |
|---|---|---|
| EP | 2 085 582 | 8/2009 |

OTHER PUBLICATIONS

Liu, Z. Gerald and Miller, Robert K., "Flow Distributions and Pressure Drops of Wall-Flow Diesel Particulate Filters," Diesel Exhaust Emission Control 2002: Diesel Particulate Filters (Sp-1673), SAE 2002 World Congress, Detroit, Michigan, Mar. 4-7, 2002.
Ogyu, K. et al., "Characterization of Thin Wall SiC-DPF," SAE International, 2003.
Yuuki, K. et al, "The Effect of SiC Properties on the Performance of Catalyzed Diesel Particulate Filter (DPF)," Diesel Exhaust Emissions Control (SP-1754 / SP-1754CD), 2003 SAE World Congress, Detroit, Michigan, Mar. 3-6, 2003.
Haralampous, O. et al., "Partial Regenerations in Diesel Particulate Filters," 2003 JSAE/SAE International Spring Fuels & Lubricants Meeting, Yokohama, Japan, May 19-22, 2003.
Gaiser, G. and Mucha, Patrick, "Prediction of Pressure Drop in Diesel Particulate Filters Considering Ash Deposit and Partial Regenerations," Diesel Exhaust Emission Control Modeling (SP-1861), 2004 SAE World Congress, Detroit, Michigan, Mar. 8-11, 2004.
Koltsakis, G. C., et al., "Performance of Catalyzed Particulate Filters without Upstream Oxidation Catalyst," Diesel Exhaust Emission Control Modeling (SP-1940), 2005 SAE World Congress, Detroit, Michigan, Apr. 11-14, 2005.

* cited by examiner

*Primary Examiner* — Hieu T Vo
(74) *Attorney, Agent, or Firm* — Matthew B. McNutt

(57) ABSTRACT

A method of controlling the operation of a particulate filter in an exhaust gas after-treatment system may comprise calculating a ratio of particulate loading rate to filter regeneration rate using a mass-based soot load estimation scheme and comparing the ratio of particulate loading rate to filter regeneration rate to a predetermined threshold value. The method may further comprise controlling operating conditions of the particulate filter to maintain the ratio of particulate loading rate to filter regeneration rate at a value above the predetermined threshold value.

18 Claims, 7 Drawing Sheets

METHODS FOR CONTROLLING THE OPERATION OF A PARTICULATE FILTER

TECHNICAL FIELD

The present teachings relate generally to methods for controlling the operation of a particulate filter, such as, for example, methods for controlling the operation of the particulate filter to maintain filter particle number slip below a predetermined threshold.

BACKGROUND

Environmental concerns have motivated the implementation of emission requirements for internal combustion engines and other combustion systems throughout much of the world. Catalytic converters have been used to eliminate many of the pollutants present in exhaust gas; however, a filter is often required to remove particulate matter, such as, for example, ash and soot. Wall-flow particulate filters, for example, are often used in engine after-treatment systems to remove particulates from the exhaust gas.

Such particulate filters may be made of a honeycomb-like substrate with parallel flow channels or cells separated by internal porous walls. Inlet and outlet ends of the flow channels may be selectively plugged, such as, for example, in a checkerboard pattern, so that exhaust gas, once inside the substrate, is forced to pass through the internal porous walls. The porous walls retain a portion of the particulates in the exhaust gas that passes therethrough. Particulate capture by the porous walls can occur in two different stages: at first, inside the porous wall (referred to as deep-bed filtration), and later, on the porous wall in the flow channels (so-referred to as cake-bed filtration). In this manner, wall-flow particulate filters have been found to be effective in removing particulates, such as, for example, ash and soot, from exhaust gas, providing relatively high filtration efficiencies throughout most of a filter's operation (e.g., providing close to 100% filtration efficiency upon onset of cake-bed filtration.) Particulate matter (PM) emission standards can, therefore, generally be met with relatively high levels of engine-out PM, which initiate an early onset of cake-bed filtration within the particulate filter.

Depending on engine calibration and the types of components used within an engine's after-treatment system, a particulate filter may, however, run in a wide range of engine-out NOx to engine-out PM (NOx/PM) ratios. A relatively low to medium NOx/PM ratio may, for example, result in the early onset of cake-bed filtration within the filter, whereas a relatively high NOx/PM ratio may result in a delayed onset of cake-bed filtration or even no cake-bed filtration within the filter. High NOx/PM ratios, for example, are generally coupled with high exhaust temperatures, which in turn tend to generate high passive regeneration rates (i.e., compared to soot accumulation rates) within the filter. Such conditions can lead to uneven soot distribution on the flow channel walls, thereby restricting the filter's operation to deep-bed filtration within part (or all) of the filter's volume. Thus, when a particulate filter is operating under high NOx/PM ratios, the filter's particle number (PN) based filtration efficiency may suffer, thereby increasing particle number slip from the filter (i.e., the number of particles that do not get trapped by the filter and are therefore emitted may increase due to the loss of cake-bed filtration within the filter).

To meet updated emission requirements, which may, for example, regulate both PM mass and PM number, it may therefore be desirable to provide a method of controlling the operation of a particulate filter to maintain particle number slip from the filter below a predetermined threshold.

SUMMARY

The present teachings may solve one or more of the above-mentioned problems and/or may demonstrate one or more of the above-mentioned desirable features. Other features and/or advantages may become apparent from the description that follows.

In accordance with various exemplary embodiments of the present teachings, a method of controlling the operation of a particulate filter in an exhaust gas after-treatment system may comprise calculating a ratio of particulate loading rate to filter regeneration rate using a mass-based soot load estimation scheme and comparing the ratio of particulate loading rate to filter regeneration rate to a predetermined threshold value. The method may further comprise controlling operating conditions of the particulate filter to maintain the ratio of particulate loading rate to filter regeneration rate at a value above the predetermined threshold value.

In accordance with various additional exemplary embodiments of the present teachings, a method of controlling the operation of a particulate filter in an exhaust gas after-treatment system may comprise measuring a pressure drop across the particulate filter and comparing the measured pressure drop to an estimated minimum pressure drop. The method may further comprise controlling operating conditions of the particulate filter to maintain the measured pressure drop at a value above the estimated minimum pressure drop, wherein the estimated minimum pressure drop is a pressure drop corresponding to a minimum soot load of the particulate filter that maintains a soot cake layer along substantially the entire length of the particulate filter.

Additional objects and advantages will be set forth in part in the description which follows, and in part will be obvious from the description, or may be learned by practice of the present teachings. The objects and advantages may be realized and attained by means of the elements and combinations particularly pointed out in the appended claims and their equivalents.

It is to be understood that both the foregoing general description and the following detailed description are exemplary and explanatory only and are not restrictive of the claims.

BRIEF DESCRIPTION OF THE DRAWINGS

The present teachings can be understood from the following detailed description either alone or together with the accompanying drawings. The drawings are included to provide a further understanding of the present teachings, and are incorporated in and constitute a part of this specification. The drawings illustrate one or more embodiments of the present teachings and together with the description serve to explain certain principles and operation.

DESCRIPTION OF VARIOUS EXEMPLARY EMBODIMENTS

Figure 1:
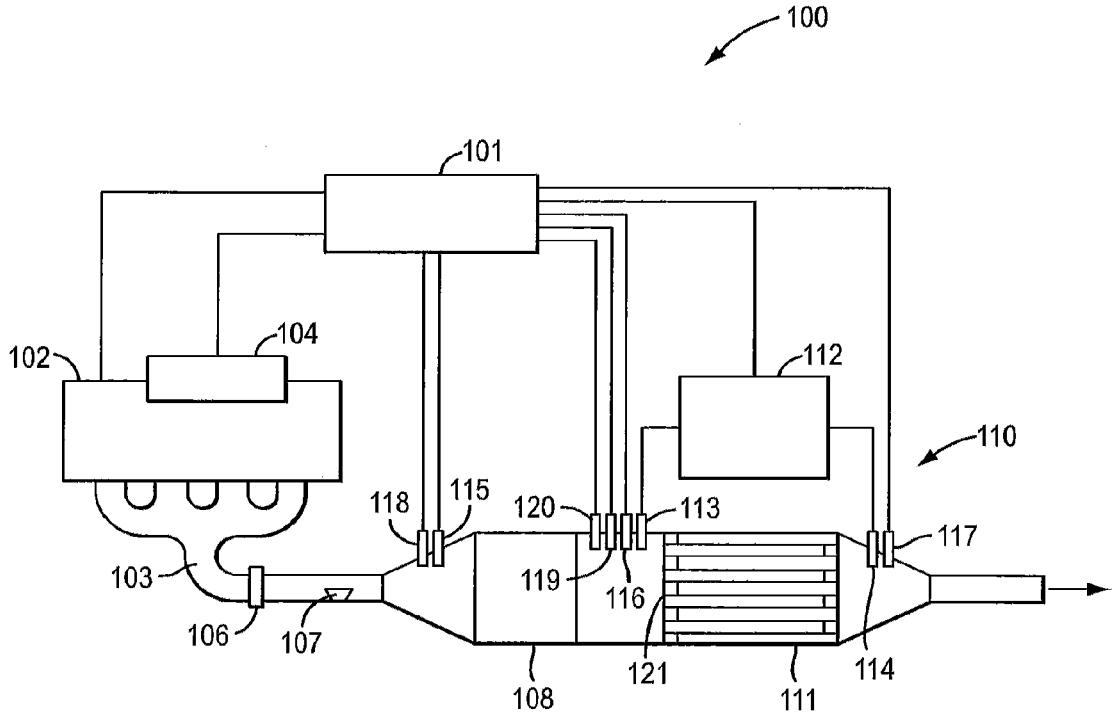
FIG. 1 is a schematic diagram showing an exemplary exhaust gas after-treatment system within a motor vehicle.

Although particulate filters can provide relatively high filtration efficiencies when operating under high engine-out particulate matter (PM) conditions, PM number filtration may become somewhat limited when engine-out PM is reduced, such as, for example, based on engine calibration and/or the types of components used within the engine's after-treatment system. Notably, particle number (PN) slip (i.e., the number of particles emitted by the particulate filter) may increase, for example, under relatively high engine-out NOx/PM conditions. That is, variability in the ratio of engine NOx emissions to engine PM emissions (e.g., engine-out NOx/PM) can, for example, impact a particulate filter's rate of regeneration and rate of soot loading, thus significantly changing the soot layer state (e.g., soot layer permeability, packing density, and distribution) in the particulate filter. This can result in increased PN slip from the filter.

To minimize PN slip from a particulate filter over the entire range of engine operation (including high engine-out NOx/PM conditions), exemplary embodiments of the present teachings consider methods of controlling the operation of a particulate filter that adjust the filter's operating conditions to maintain a soot cake layer on flow channel walls within the filter along substantially the entire length of the filter. Accordingly, exemplary embodiments of the present teachings consider methods of controlling the operation of a particulate filter that adjust the filter's operating conditions to maintain cake-bed filtration within the filter.

Exemplary embodiments mentioned above and described herein, therefore, include various methods of controlling the operation of a particulate filter to maintain PN slip below a predetermined threshold, such as, for example, methods based on a filter L/R ratio (i.e., operation window based control methods) and methods based on a pressure drop (dP) across the filter (i.e., pressure drop based control methods). Control methods based on L/R ratios may, for example, calculate an L/R ratio of the filter using a mass-based soot load estimator, and thereby adjust one or more of the filter's operating conditions to increase the L/R ratio when the calculated L/R ratio is less than or equal to a threshold value (i.e., a minimum L/R ratio to maintain a soot cake layer along substantially the entire length of the filter). Control methods based on pressure drop may, for example, estimate a soot load (SL) of a particulate filter to estimate a minimum pressure drop ($dP_{min}$) (i.e., a pressure drop corresponding to a minimum soot load that maintains a soot cake layer along substantially the entire length of the filter), and thereby adjust one or more of the filter's operating conditions to increase an L/R ratio when a measured dP is less than or equal to the $dP_{min}$.

As used herein, the term "particulate filter" or "filter" refers to a structure which is capable of removing particulate matter, such as, for example, soot and ash, from a fluid stream, such as, for example, an exhaust gas stream, passing through the structure. The present teachings may apply to the removal of soot and ash and/or other particulate matter from any exhaust gas stream, such as, for example, exhaust gases produced by internal combustion engines, such as gasoline and diesel engines, and coal combustion flue gases produced in coal gasification processes. As used herein, the term "soot" refers to impure carbon particles that result from the incomplete combustion of hydrocarbons, such as, for example, during the internal combustion process. The term "ash" refers to non-combustible metallic material that is found in almost all petroleum products. For diesel applications, "ash" is typically produced from crankcase oil and/or fuel borne catalysts.

As used herein, the term "controlling operating conditions" refers to the control and/or adjustment of the conditions to which a particulate filter is subjected during the filtration of exhaust gas, regardless of the type of control scheme used. By way of example only, the present teachings contemplate using any known suitable control methods and/or techniques, including, but not limited to, various engine maps used to control engine output conditions. Exemplary engine maps include, for example, NOx/PM/temperature maps. Those ordinarily skilled in the art are familiar with various control methods and/or techniques for controlling the operating conditions of a particulate filter and the present teachings contemplate any such control techniques.

The filters of the present teachings can have any shape or geometry suitable for a particular application, as well as a variety of configurations and designs, including, but not limited to, a flow-through structure, a wall-flow structure, or any combination thereof (e.g., a partial-flow structure). Exemplary flow-through structures include, for example, any structure comprising channels or porous networks or other passages that are open at both ends and permit the flow of exhaust gas through the passages from one end to an opposite end. Exemplary wall-flow structures include, for example, any structure comprising channels or porous networks or other passages with individual passages open and plugged at opposite ends of the structure, thereby enhancing gas flow through the channel walls as the exhaust gas flows from one end to the other. Exemplary partial-flow structures include, for example, any structure that is partially flow-through and partially wall-flow. In various exemplary embodiments, the filters, including those filter structures described above, may be monolithic structures. Various exemplary embodiments of the present teachings, contemplate utilizing the cellular geometry of a honeycomb configuration due to its high surface area per unit volume for deposition of soot and ash. Those having ordinary skill in the art will understand that the cross-section of the cells of a honeycomb structure may have virtually any shape and are not limited to hexagonal. Similarly, a honeycomb structure may be configured as either a flow-through structure, a wall-flow structure, or a partial-flow structure.

FIG. 1 is a schematic, block diagram showing an exemplary exhaust gas after-treatment system 100 within a motor vehicle. The after-treatment system 100 is shown in operational relationship with an internal combustion engine 102. The engine 102 can be any type of internal combustion engine, including, but not limited to, for example, an auto-cycle engine, a two-stroke engine or a diesel engine, used in any type of machine or vehicle, stationary or moving, including but not limited to a pump, generator, automobile, truck, boat, or train.

The engine 102 has an exhaust manifold 103 to direct exhaust gases from the engine 102 to an exhaust system 110. Exhaust system 110 is coupled to the exhaust manifold 103 via an exhaust flange 106 and may include a particulate filter 111 and various sensors that monitor the operating conditions of the particulate filter 111, including, for example, a pressure drop sensor 112, and temperature sensors 116 and 117. In an exemplary embodiment of a diesel engine, depicted for example, in FIG. 1, a doser 107 for hydrocarbon injection supplied by post- or in-cylinder injection, a temperature sensor 115 and a diesel oxidation catalyst (DOC) 108 may also be provided upstream of the particulate filter 111. Also in an exemplary embodiment, as depicted for example in FIG. 1, a flow rate sensor 118 may also be included. As would be understood by those ordinarily skilled in the art, however, flow rate may also be calculated rather than or in addition to being sensed.

In various additional exemplary embodiments, as also shown in FIG. 1, a nitrogen oxide (NOx) sensor 119 and/or a soot sensor 120 may also be provided upstream of the particulate filter 111. As would be understood by those of ordinary skill in the art, exhaust gas flowing between the engine 102 and the filter 111 may be treated by various components, such as, for example, the doser 107 and the DOC 108, prior to reaching the particulate filter 111. Accordingly, to obtain true engine-out NOx and/or engine-out soot levels at the filter 111 (i.e., readings that account for changes made to the exhaust between the engine 102 and the filter 111), as shown in FIG. 1, in various embodiments, the NOx sensor 119 and the soot sensor 120 may be positioned proximate to an inlet end 121 of the particulate filter 111.

As would be further understood by those of ordinary skill in the art, however, engine-out NOx and/or engine-out soot may also be determined via model-based lookup tables (also referred to herein as virtual sensors) rather than or in addition to being physically sensed. Accordingly, depending on what types of sensors are available and what type of information is required for the control method used, various embodiments of the present teachings additionally consider sensing and/or determining various operating conditions of the particulate filter 111.

Although the particulate filter 111 is depicted as a cylindrical wall-flow monolith, those ordinarily skilled in the art would understand that such shape and configuration is exemplary only and particulate filters in accordance with the present teachings may have any shape or geometry suitable for a particular application, as well as a variety of configurations and designs, including, but not limited to, a wall-flow structure, a flow-through structure, and a partial-flow structure, any of which also may be a monolithic structure.

Those having ordinary skill in the art will further understand that the number and positioning of sensors 112, 115, 116, 117, 118, 119 and 120, and the various post-combustion gas treatment components, such as for example the doser 107 and the DOC 108, depicted in FIG. 1, are schematic and exemplary only and that the exhaust system 110 may include a variety of sensor configurations and engine exhaust treatment components without departing from the scope of the present teachings.

Those having ordinary skill in the art would understand how to modify the sensors and/or components depicted in FIG. 1 based on the desired treatment and control mechanism without departing from the scope of the present teachings. Various exemplary embodiments of the present teachings, for example, contemplate the pressure drop sensor 112 as a set of sensors 113 and 114 positioned upstream and downstream of the particulate filter 111, respectively. Various additional exemplary embodiments of the present teachings consider a single pressure drop sensor 112 configured to measure the differential pressure across the particulate filter 111. Various exemplary embodiments of the present teachings further contemplate, for example, a set of sensors 116 and 117 respectively positioned upstream and downstream of the particulate filter 111 to determine, for example, an average temperature of the exhaust gas flowing through the particulate filter 111. Various additional exemplary embodiments of the present teachings also contemplate a single temperature sensor 116 configured to measure the input temperature of the particulate filter 111, for example, when only one sensor is available, whereas various further exemplary embodiments of the present teachings contemplate a single temperature sensor 117 configured to measure the output temperature of the particulate filter 111, for example, during regeneration conditions. Furthermore, various exemplary embodiments of the present teachings additionally consider the temperature sensor 115 configured to measure the DOC-out/particulate filter-in exhaust gas temperature using an energy balance on the DOC 108.

Based on the present teachings, those having ordinary skill in the art would understand various other sensor types, positions, and/or configurations that may be used to measure and/or provide operating conditions of a particulate filter to implement the control methods of the present teachings.

Various exemplary embodiments of the present teachings contemplate using existing sensors already available as part of the exhaust system 110. Various exemplary embodiments of the present teachings also contemplate systems which include additional sensors as needed to provide the signal inputs used in the methods of the present teachings. Those skilled in the art would understand that the type, number and configuration of such sensors may be chosen as desired based on availability, expense, efficiency and other such factors.

Those ordinarily skilled in the art also would understand that the exhaust system 110, as a whole, is exemplary only and not intended to be limiting of the present teachings and claims. For example, in FIG. 1, the DOC 108 may be positioned upstream of the particulate filter 111 to better facilitate heating of the exhaust gas through reactions with hydrocarbons (HC) provided, for example, by post or in-cylinder injection by doser 107. Depending upon the type of engine used and the particular application employed, the exhaust system 110 may include additional after-treatment components, such as, for example, additional catalysts, traps, mufflers, heaters, reductant injectors, and/or bypass valves (not shown) in combination with the particulate filter 111. One or more such after-treatment components may be positioned in the flow path of the exhaust downstream of the engine 102 and upstream of the particulate filter 111.

A controller 101 may be configured to receive signals from sensors, which monitor the operating conditions of the particulate filter 111, such as, for example, the pressure drop sensor 112, temperature sensors 115, 116, and 117, and the flow rate sensor 118. In various exemplary embodiments of the present teachings, the engine 102 can include additional sensors and/or instrumentation, indicated generally at 104, which provide information about engine performance (e.g., amount of oil consumed, mass airflow etc.) and engine running conditions (e.g., load, rotation speed etc.) to the controller 101. The additional sensors and/or instrumentation, indicated generally at 104, can also provide information regarding engine soot generation, and soot burned through active and passive regeneration (e.g., engine map, engine backpressure, transient factor, mass flow rate (Mexh), exhaust pressure, bed temperature, $O_2$ concentration, NO concentration, and $NO_2$ concentration). The controller 101 may include an existing controller such as an engine control unit (ECU), a dedicated controller, or control may be distributed among more than one controller, as would be understood by those having ordinary skill in the art. As would be further understood by those of ordinary skill in the art, the controller 101 may comprise any type of control loop feedback mechanism, including, for example, a proportional-integral-derivative controller (PID controller) and/or a state machine.

In accordance with various exemplary embodiments of the present teachings, when using an operation window based control scheme, the controller 101 may, for example, be configured to dynamically estimate a mass-based soot load ($SL_{MB}$) of the particulate filter 111 based on the signals received from one or more of the sensors 104 and one or more of the temperature sensors 115, 116 and 117 as would be understood by those having ordinary skill in the art depending on which sensors are available in the engine's after-treatment system. Those having ordinary skill in the art would understand, for example, that in various exemplary embodiments of the present teachings, the $O_2$ and $NO_2$ concentration may also be estimated rather than or in addition to being sensed based on open-loop look up tables based on the engine 102 and the DOC 108 operating conditions.

As would be understood by those of ordinary skill in the art, during the mass-based soot load estimation, a current soot load ($SL_{i+1}$) may be updated, for example, using the soot load from the previous time step ($SL_i$), the current particulate loading rate (L), and the current filter regeneration rate (R) (e.g., $SL_{i+1}=SL_i+L-R$). Accordingly, the controller 101 may be configured to calculate an instantaneous ratio of particulate loading rate to filter regeneration rate (L/R), such as, for example, a ratio of soot loading rate to filter regeneration rate based on the L and R values utilized for the mass-based soot load estimate (i.e., $SL_{MB}$ and L/R ratio can be derived in parallel) as set forth in the following exemplary embodiments.

In various embodiments, for example, a mass-based soot load may be estimated based on a filter ash load, a filter temperature (T), a $NO_2$/NOx ratio, a NOx concentration, a PM concentration, an elementary carbon/organic carbon (EC/OC) split, an exhaust gas mass flow rate (MEXH), and an $O_2$ concentration. An instantaneous filter L/R ratio may, therefore, be expressed using the following functional relation:

$$\frac{L}{R} = f\left(\mathrm{NO}_x, \frac{\mathrm{NO}_2}{\mathrm{NO}_x}, PM, \frac{EC}{OC}, T, MEXH, SL, AL, \mathrm{SL_dis}, \mathrm{AL_dis}\right) \quad [1]$$

wherein SL is the soot load of the filter, AL is the ash load of the filter, SL_dis is the soot load distribution within the filter, and AL-dis is the ash load distribution within the filter.

In accordance with various additional embodiments, an instantaneous loading rate (L) and regeneration rate (R) can be estimated, for example, from filter weight and engine emissions (e.g., NOx and soot) using a conventional mass balance approach. By way of example only, the present teachings contemplate using any known suitable mass balance based soot estimation methods and/or techniques, including, but not limited to, estimating an amount of soot mass change in the particulate filter 111. An amount of soot mass change, in the particulate filter 111, can be defined, for example, as: the mass of soot added from the exhaust gas stream—(the mass of soot burnt during passive regeneration due to reaction with $NO_2$+ the mass of soot burnt during active regeneration due to reaction with $O_2$). In other words, the instantaneous mass balance based soot load (or change in soot mass) in the particulate filter 111 may be estimated by determining the soot influx into the filter and subtracting the soot burnout by filter regeneration.

It is envisioned, however, that a variety of mass-based approaches to soot load estimation known to those skilled in the art may be implemented when calculating an instantaneous L/R ratio, including, for example, the mass-based estimation approach as disclosed, for example, in U.S. application Ser. No. 12/625,049, entitled "Mass Based Methods and Systems for Estimating Soot Load," filed Nov. 24, 2009, the entire contents of which are incorporated by reference herein.

The controller 101 may be configured to compare the instantaneous L/R ratio to a predetermined threshold value and control the operating conditions of the particulate filter 111 to maintain the L/R ratio at a value above the predetermined threshold value. In various exemplary embodiments, for example, the predetermined threshold value may comprise the minimum L/R ratio that maintains a soot cake layer along substantially the entire length of the particulate filter 111. In other words, the predetermined threshold value may comprise an L/R ratio indicative of a predetermined PN slip threshold value (i.e., a pre-set PN slip limit), and the controller 101 may adjust one or more operating conditions of the particulate 111 to maintain PN slip below the predetermined threshold value by increasing the L/R ratio of the filter.

The exemplary method described above relates to the implementation of an operation window based control scheme, which considers an instantaneous L/R ratio of a filter, to maintain filter particle number slip below a predetermined threshold. A second exemplary embodiment in accordance with the present teachings may utilize a pressure drop based control scheme, which considers a minimum pressure drop ($dP_{min}$) across the filter, to maintain filter particle number slip below a predetermined threshold. In various embodiments, for example, the controller 101 may be configured to dynamically measure a pressure drop (dP) across the particulate filter 111 based on the signals received from the pressure drop sensor 112. The controller 101 may be configured to compare the measured dP to an estimated minimum pressure drop ($dP_{min}$) and control the operating conditions of the particulate filter 111 to maintain the measured dP at a value above the estimated $dP_{min}$. In various exemplary embodiments, for example, the estimated $dP_{min}$ may comprise a pressure drop that corresponds to a minimum soot load of the particulate filter 111 that maintains a soot cake layer along substantially the entire length of the particulate filter 111. In other words, the estimated $dP_{min}$ may comprise a dP value indicative of a predetermined PN slip threshold value (i.e., a pre-set PN slip limit), and the controller 101 may adjust one or more operating conditions of the particulate filter 111 to maintain PN slip below the predetermined threshold value by increasing an L/R ratio of the filter.

In various exemplary embodiments, the controller 101 may be configured to determine the estimated $dP_{min}$ based on an instantaneous soot load (SL) of the particulate filter 111. The controller 101 may be configured, for example, to dynamically estimate SL (e.g., a mass-based soot load ($SL_{MB}$) and/or a pressure drop-based soot load ($SL_{PB}$)) based on the signals received from one or more of the sensors 104, the pressure drop sensor 112, temperature sensors 115, 116, and 117, and the flow rate sensor 118 as would be understood by those having ordinary skill in the art depending on which sensors are available in the engine's after-treatment system.

Figure 7:
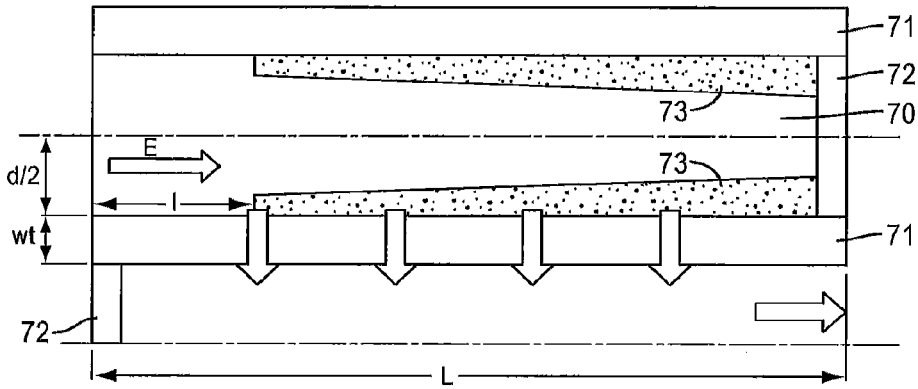
FIG. 7 shows a simplified, one-dimensional model illustrating soot distribution on a flow channel wall within a particulate filter.

As would be further understood by those of ordinary skill in the art, $dP_{min}$ is a function of soot distribution and soot cake permeability within the particulate filter 111, and may, therefore, be expressed using the following functional relation:

$$dP_{min} = dP(\mathrm{TR}=0, \mathrm{SS}=1) \quad [2]$$

wherein TR is a through ratio (empty wall length (l)/total channel length (L)), representing the ratio of a flow channel's filtration surface solely dependent on depth filtration; and SS is a scaled slope, representing the slope of a soot cake distribution profile within a flow channel divided by the maximum possible slope (channel diameter (d)/[2(L−l)]) (see FIG. 7).

In various embodiments, an estimated $dP_{min}$ can therefore be projected through the estimated SL as will be described in further detail below with regard to FIGS. 7 and 8. In various additional embodiments, $dP_{min}$ may also be determined via model-based lookup tables rather than or in addition to being projected via online estimation.

Although it is envisioned that a variety of approaches to soot load estimation known to those skilled in the art may be implemented to determine an estimated $dP_{min}$, various exemplary embodiments in accordance with the present teachings may utilize ultrasound approaches, mass-based approaches (e.g., as disclosed above), and/or pressure drop-based approaches, such as disclosed, for example, in U.S. application Ser. No. 12/324,090, entitled "Methods for Estimating Particulate Load in a Particulate Filter, and Related Systems," filed Nov. 26, 2008, the entire contents of which are incorporated by reference herein.

Figure 2:
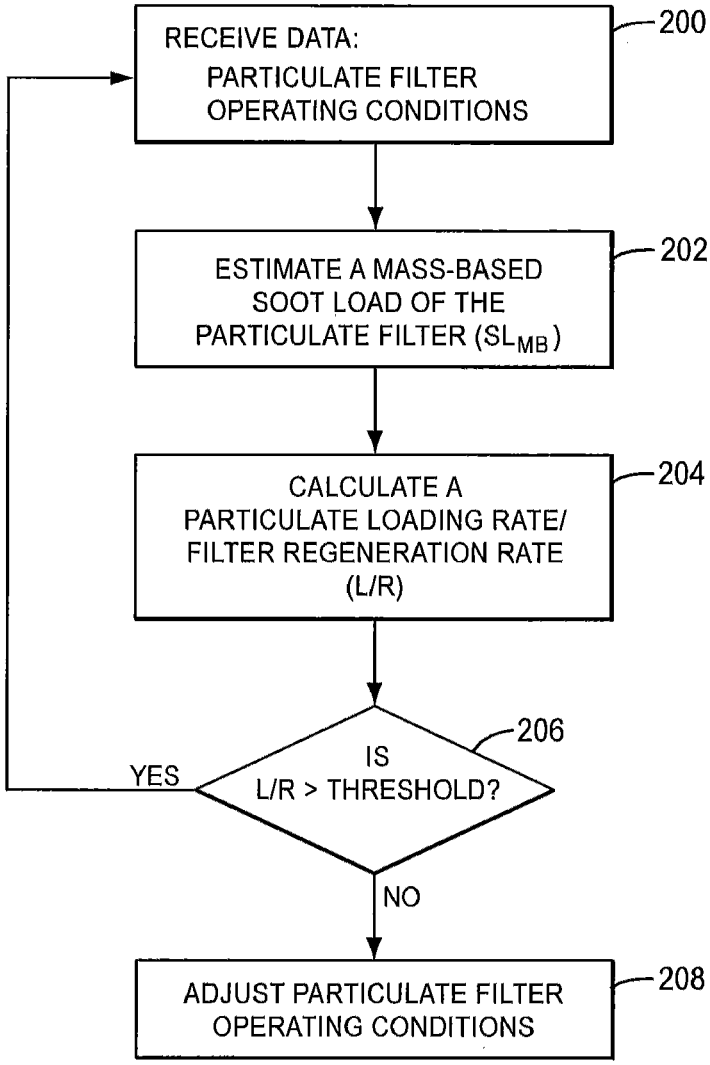
FIG. 2 is a flow diagram depicting an exemplary embodiment of a first method for controlling the operation of a particulate filter in accordance with the present teachings.

FIG. 2 shows a logic flow diagram depicting an exemplary embodiment for controlling the operation of a particulate filter in accordance with the operation window based control scheme described above. As shown at step 200 of FIG. 2, data corresponding to particulate filter operating conditions is received, for example, from one or more sensors. The sensors may be selected from a variety of sensors such as those described above with reference to the exemplary embodiment of FIG. 1. The signals can correspond to the temperature, flow rate, and pressure drop of an exhaust gas flowing through the particulate filter, information about engine emissions (e.g., engine-out NOx and engine-out soot), information about the configuration of the particulate filter (e.g., geometry and microstructure), as well as one or more engine operating conditions, such as, for example, the amount of oil consumed and/or engine run time, and one or more engine running conditions, such as, for example, load and/or rotation speed.

Various exemplary embodiments of the present teachings additionally consider directly estimating filter operating conditions from other measurements, such as, for example, directly estimating a flow rate of the exhaust from measurements, such as, for example, engine speed and load or fuel flow and air flow. The exhaust flow rate can be estimated, for example, by adding the flow rate of the air admitted into the engine and the total quantity of fuel injected into the engine.

As shown at step 202 of FIG. 2, a mass-based soot load estimate ($SL_{MB}$) in the particulate filter is continuously calculated from the measured or estimated data. In various exemplary embodiments, for example, $SL_{MB}$ may be estimated based on a filter ash load, a filter temperature, a $NO_2$/NOx ratio, a NOx concentration, a particulate matter concentration, an elementary carbon/organic carbon (EC/OC) split, an exhaust gas mass flow rate, and an $O_2$ concentration. The present teachings contemplate using any known mass-based soot load estimation methods and/or techniques as would be understood by those of ordinary skill in the art, including, for example, a mass balance based approach as described above.

As shown at step 204 of FIG. 2, an instantaneous ratio of particulate loading rate to filter regeneration rate, such as, for example, an instantaneous ratio of soot loading rate to filter regeneration rate, (L/R) may be calculated based on the L and R values derived during calculation of the $SL_{MB}$. The present teachings contemplate using any known methods and/or techniques as would be understood by those of ordinary skill in the art to calculate the L/R ratio, including, for example, expressing L/R using the functional relationship of equation [1], as disclosed, for example, in U.S. application Ser. No. 12/324,090, the entire contents of which are incorporated by reference herein.

At step 206 of FIG. 2, the calculated L/R ratio can then be compared to a predetermined threshold value to determine whether or not the L/R ratio is within an L/R operational window. If the calculated L/R ratio is less than or equal to the threshold value, the system may adjust one or more of the operating conditions of the particulate filter to increase the L/R ratio, as indicated by the last step, 208, shown in the flow diagram of FIG. 2. In various exemplary embodiments, for example, the predetermined threshold value may comprise the minimum L/R ratio that maintains a soot cake layer along substantially the entire length of the particulate filter. In other words, the predetermined threshold value may comprise an L/R ratio indicative of a predetermined PN slip threshold value (i.e., a pre-set PN slip limit), and the system may adjust one or more of the operating conditions of the filter to maintain PN slip below the predetermined threshold value by increasing the L/R ratio of the filter.

The present teachings contemplate using any known suitable control methods and/or techniques as would be understood by those of ordinary skill in the art to adjust the operating conditions of the particulate filter. By way of example only, the present teachings contemplate adjusting one or more of the operating conditions of the filter by changing an engine map to adjust an engine output, such as, for example, changing a NOx/particulate matter (PM)/temperature (T) map to adjust a NOx/PM/T output.

As would be understood by those of ordinary skill in the art, in non-exhaust gas recirculation (EGR) equipped engines, changing a NOx/PM/T map may include, for example, controlling injection start time, achieving multiple injection events, managing air within VGT equipped engines, and/or adjusting fuel injection pressure. In EGR equipped engines, changing a NOx/PM/T map may additionally include varying EGR flow.

Figure 3:
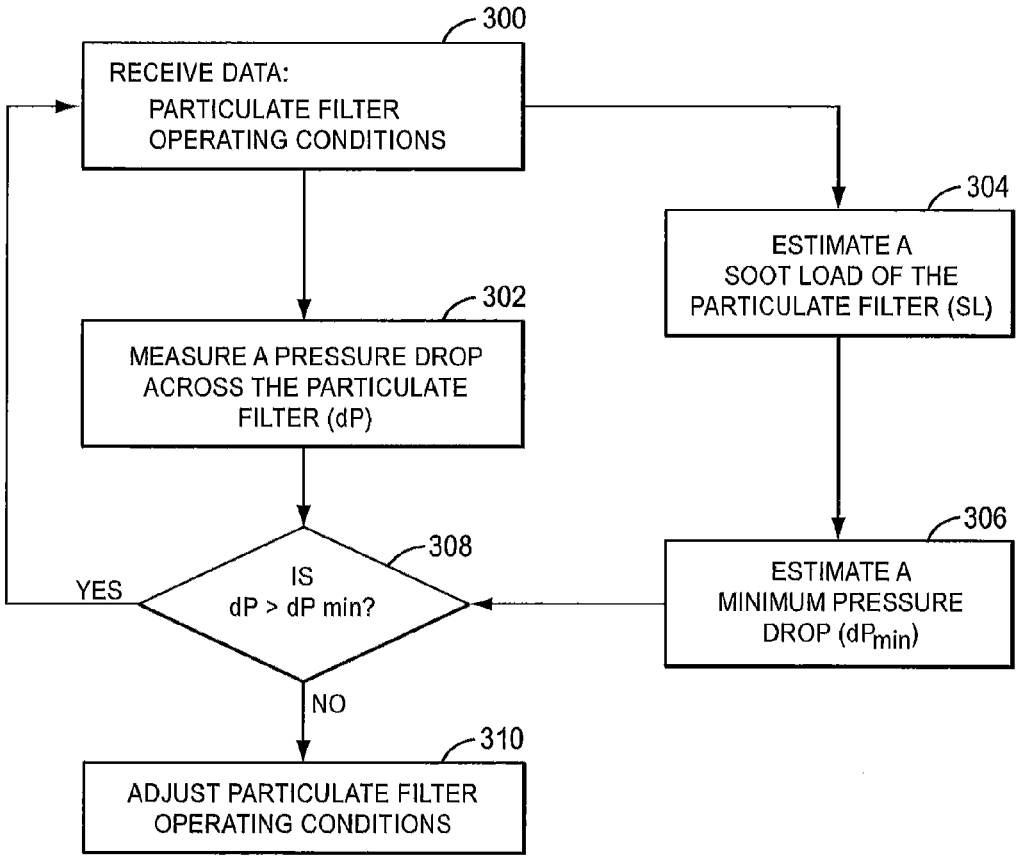
FIG. 3 is a flow diagram depicting an exemplary embodiment of a second method for controlling the operation of a particulate filter in accordance with the present teachings.

Referring now to FIG. 3, a flow diagram depicting an exemplary embodiment for controlling the operation of a particulate filter in accordance with the pressure drop based control scheme as described above is depicted. As shown at step 300 of FIG. 3, data corresponding to particulate filter operating conditions is received, for example, from one or more sensors. The sensors may be selected from a variety of sensors such as those described above with reference to the exemplary embodiment of FIG. 1. As above, the signals can correspond to the temperature, flow rate, and pressure drop of an exhaust gas flowing through the particulate filter, information about engine emissions (e.g., engine-out NOx and engine-out soot), information about the configuration of the particulate filter (e.g., geometry and microstructure), as well as one or more engine operating conditions, such as, for example, the amount of oil consumed and/or engine run time, and one or more engine running conditions, such as, for example, load and/or rotation speed.

As shown at step 302 of FIG. 3, an instantaneous pressure drop (dP) across the filter is measured, for example, from the pressure drop signal. As above, however, various exemplary embodiments of the present teachings additionally consider directly estimating (as opposed to sensing) one or more filter operating conditions, including the dP, from other measurements.

As shown at step 304 of FIG. 3, in various embodiments, a soot load estimate (SL) in the particulate filter is continuously calculated from the measured or estimated data. The present teachings contemplate using any known soot load estimation methods and/or techniques as would be understood by those of ordinary skill in the art, including, for example, ultrasound estimation methods, mass-based estimation methods, and pressure drop-based estimation methods as described above.

At step 306 of FIG. 3, a minimum pressure drop ($dP_{min}$) may be estimated based on the estimated SL. The present teachings contemplate using any known methods and/or techniques as would be understood by those of ordinary skill in the art to estimate the $dP_{min}$, including, for example, expressing $dP_{min}$ using the functional relationship of equation [2] as shown below.

As shown at step 308 of FIG. 3, the measured dP can then be compared to the estimated $dP_{min}$ to determine whether or not the soot distribution within the filter is sufficient, for example, to maintain PN slip within desirable ranges. If the measured dP is less or equal to the estimated $dP_{min}$, the system may adjust one or more of the operating conditions of the particulate filter to increase the L/R ratio, as indicated by the last step, 310, shown in the flow diagram of FIG. 3. In various exemplary embodiments, for example, the estimated $dP_{min}$ may comprise a pressure drop that corresponds to a minimum soot load of the particulate filter to maintain a soot cake layer along substantially the entire length of the particulate filter. In other words, the estimated $dP_{min}$ may comprise a dP value indicative of a predetermined PN slip threshold value (i.e., a pre-set PN slip limit), and the system may adjust one or more operating conditions of the particulate filter to maintain PN slip below the predetermined threshold value by increasing an L/R ratio of the filter.

As above, the present teachings contemplate using any known suitable control methods and/or techniques as would be understood by those of ordinary skill in the art to adjust the operating conditions of the particulate filter. By way of example only, the present teachings contemplate adjusting one or more of the operating conditions of the filter by changing an engine map to adjust an engine output, such as, for example, changing a NOx/particulate matter/temperature map to adjust a NOx/particulate matter/temperature output.

Figure 4:
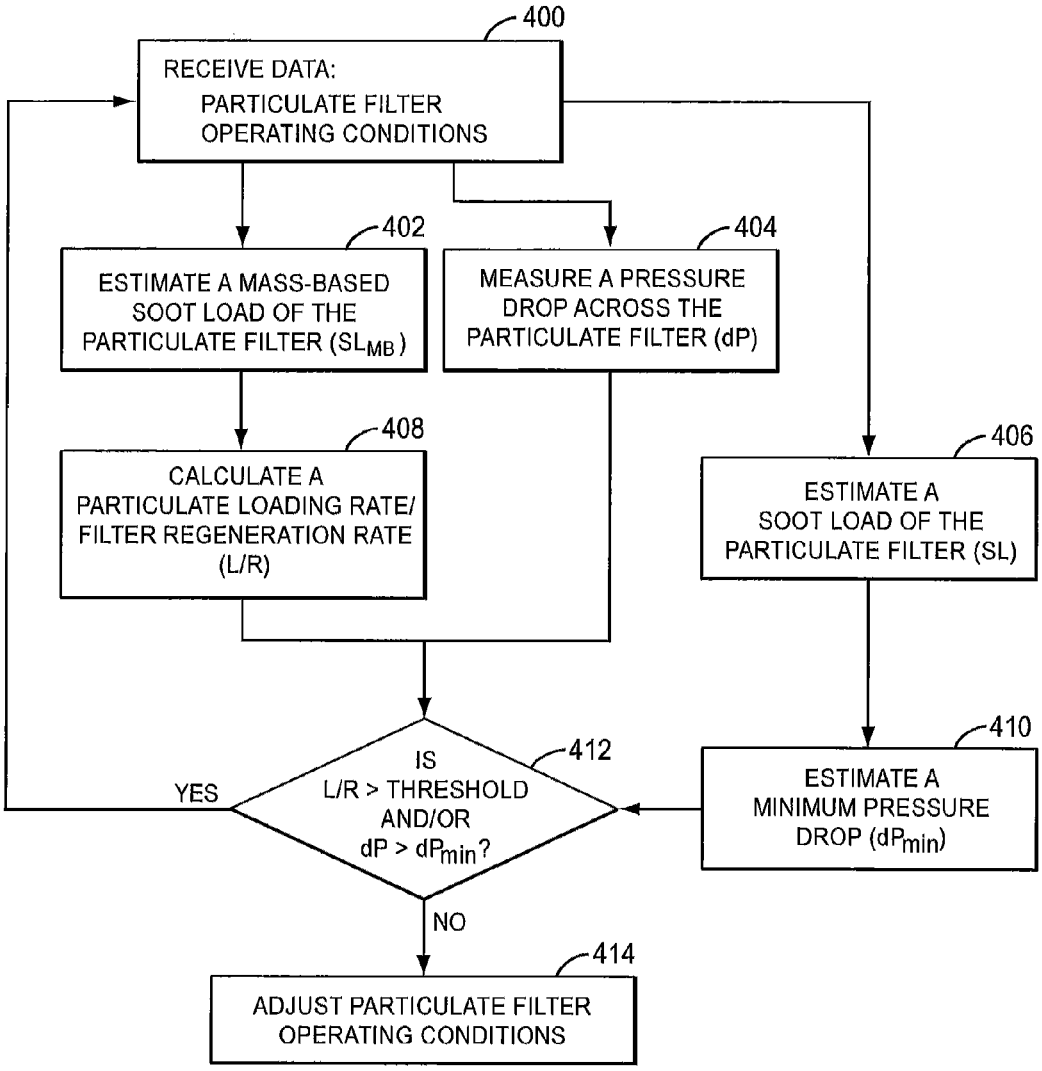
FIG. 4 is a flow diagram depicting an exemplary embodiment of a method for controlling the operation of a particulate filter combining the methods of FIGS. 2 and 3.
Figure 5A:
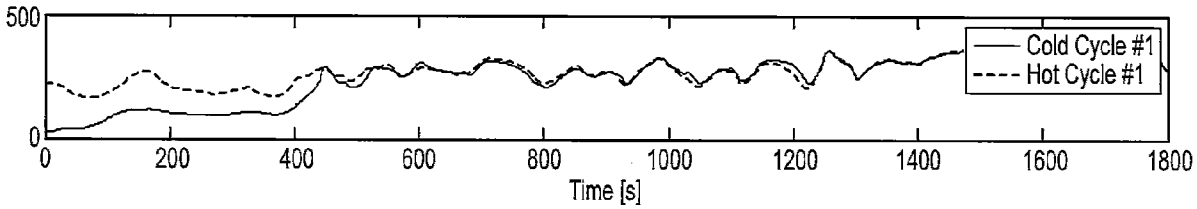
FIGS. 5A, 5B, 5C and 5D show various filter operating conditions versus time for an exemplary experimental engine test cycle.
Figure 5B:
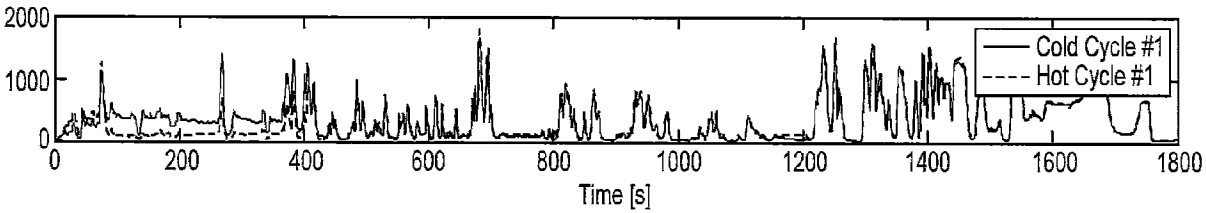
Figure 5C:
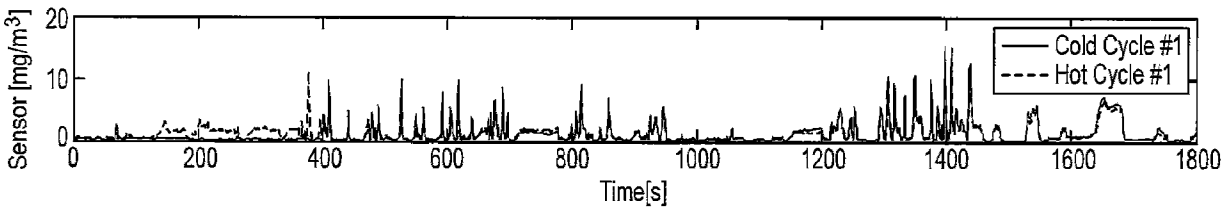
Figure 5D:
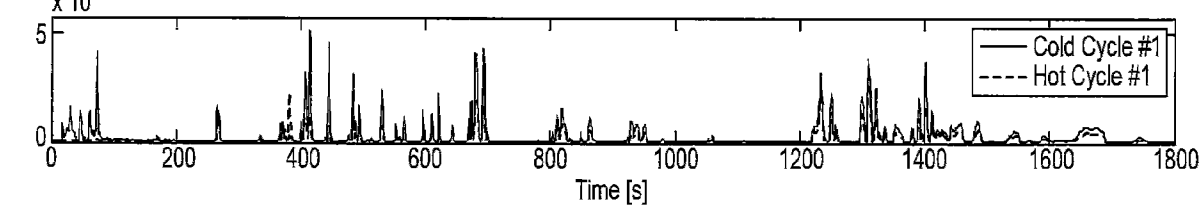

Referring now to FIG. 4, a flow diagram depicting an exemplary embodiment for controlling the operation of a particulate filter, which combines the methods of FIGS. 2 and 3, is depicted. As shown at step 400 of FIG. 4, data corresponding to particulate filter operating conditions is received, for example, from one or more sensors, and/or is directly estimated from other measurements. As shown respectively at steps 402, 404 and 406 of FIG. 4, a mass-based soot load estimate ($SL_{MB}$), an instantaneous pressure drop (dP), and a soot load estimate (SL) (e.g., $SL_{MB}$ and/or $SL_{PB}$) are continuously measured/calculated from the measured or estimated data.

As shown respectively at steps 408 and 410 of FIG. 4, an instantaneous L/R ratio may be calculated based on the estimated $SL_{MB}$ and a $dP_{min}$ may be estimated based on the estimated SL.

At step 412 of FIG. 4, the calculated L/R ratio can be compared to a predetermined threshold value and/or the measured dP can be compared to the estimated $dP_{min}$. If the calculated L/R ratio is less or equal to the threshold value and/or the measured dP is less or equal to the estimated $dP_{min}$, the system may adjust one or more of the operating conditions of the particulate filter to increase the L/R ratio, as indicated by the last step, 414, shown in the flow diagram of FIG. 4.

Those of ordinary skill in the art would understand that there are various methods and/or techniques to combine two control schemes, including, for example, a Boolean logic method and/or a scheduling method. Under Boolean logic, for example, a system may adjust an L/R ratio through an engine mapping change when both schemes (i.e., operation window and pressure drop) give a GO signal (i.e., using AND logic), or when either scheme gives a GO signal (i.e., using OR logic). Whereas, under scheduling logic, a system may utilize one scheme under a first set of operating conditions and the other scheme under a second set of operating conditions.

As would be further understood by those of ordinary skill in the art, to optimize an after-treatment system's design and performance, control schemes in accordance with the present teachings may also incorporate additional inputs (i.e., in addition to the filter operating conditions described above), such as, for example, backpressure, fuel/urea/$CO_2$ penalty, and exhaust temperature, as required by deNOx system operations. In this manner, a particulate filter may be controlled to operate within PN slip regulations while exploiting other performance criteria, such as, for example, passive regeneration, pressure drop, and system fuel economy. To achieve both a relatively low filter pressure drop and a regulated PN slip, for example, the present teachings enable the usage of filters made of relatively high mean pore size materials.

As those of ordinary skill in the art would understand, for example, an engine may trigger a passive clean out (e.g., the engine may run under high NOx/PM conditions and/or with an elevated temperature to facilitate passive regeneration inside a filter) if the soot load inside a filter is over a threshold value. Accordingly, in various exemplary embodiments, a regeneration control module may be applied, for example, which uses the PN slip control module to control PN slip through the L/R ratio while also achieving a fast filter regeneration rate (R) to clean out the filter.

EXAMPLES

Figure 6:
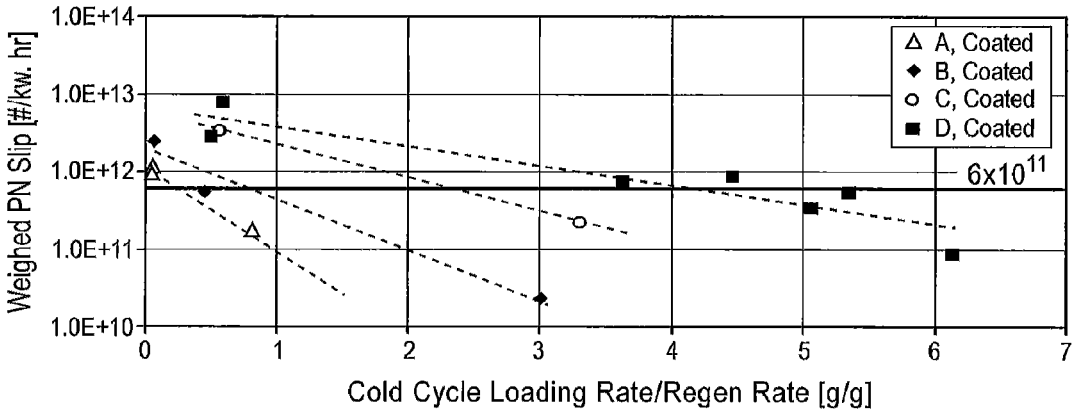
FIG. 6 shows results obtained from experimental tests of weighed particle numbers slip as a function of filter loading rate/filter regeneration rate (L/R) for various filter materials.

To further demonstrate the above control methods, experimental tests were run and numerical models were developed, as shown and described below with reference to FIGS. 5-8. As illustrated in FIGS. 5 and 6, to demonstrate an operation window based control method in accordance with the present teachings, experimental tests were run to evaluate and determine a PN slip threshold for a set of diesel particulate filters (dPFs). Four sets of catalyst-coated DPF samples (A, B, C and D), all having the same filter geometry (i.e., cell density and web thickness) but different material mean pore sizes (D>C>B>A) were tested for PN slip. The tests were run using engine exhaust having an extremely low engine-out PM (i.e., in the order of $10^{-2}$ g/kW-hr) and a relatively high total particulate number (i.e., in the order of $10^{13}$ #/KW-hr). As illustrated in FIGS. 5A-5D for one DPF sample (sample D) in the experiments, both cold and hot World Harmonized Transient Cycles (WHTC) were run with various NOx/PM/T engine out combinations. Accordingly, as would be understood by those of ordinary skill in the art, the tests were run using a clean filter (i.e., after a complete filter clean out) that was preconditioned for 15 minutes under an engine speed C and a 100% load (C100) and for 30 minutes under an engine speed A and a 25% load (A25). Each filter was then allowed to cool at room temperature for about 10 hours.

Due to the low engine-out PM conditions, the onset of cake-bed filtration within the filters was delayed (i.e., soot layer formation on flow channel walls within the filters was delayed), thereby initially resulting in high levels of PN slip. It was observed, however, that PN slip drops with more and more soot accumulation within a filter.

A weighed PN slip (e.g., a*PN_cold_cycle+b*PN_hot_cycle, wherein a=0.14 and b=0.86), as characterized by proposed European regulations, was used, for example, to characterize filter filtration performance for each filter. Those of ordinary skill in the art would understand, however, that the above characterization is exemplary only, and that constants a and b are variable and dependent upon the particular regulation imposed. Soot loading rate (L) and filter regeneration rate (R) during the first cold cycle was determined to be important as more PN slip occurred during that period. Accordingly, as illustrated in FIG. 6, filter L/R ratio during the first cold cycle was used to characterize the filter filtration performance of each filter. FIG. 6 shows the weighed PN slip during the cold/hot cycle tests, which is a function of filter operating conditions (e.g., the L/R ratio during the cold cycle) and filter material. Due to faster transition from deep-bed to cake-bed filtration, as illustrated in FIG. 6, less PN slip was observed with lower mean pore sizes and higher L/R ratios. If a PN limit is set, for example, at $6\times10^{11}$ (based on the proposed European regulations for a transient state), as shown in FIG. 6, the L/R ratio has to exceed about 0.4 g/g for filter A and about 4 g/g for filter D to achieve the PN slip threshold.

Accordingly, FIG. 6 defines the operation window to regulate PN slip (i.e., defines a predetermined threshold value of L/R), which can vary with filter design (e.g., geometry and material mean pore size). Those of ordinary skill in the art would understand, therefore, that the above filter configurations are exemplary only and that filter L/R ratios are also a function of filter geometry, microstructure and the other components within an engine's after-treatment system (i.e., operation windows are filter specific). Thus, for example, when considering two after-treatment systems with exactly the same engine-out conditions (NOx/PM/Temperature/MassExhaustFlow), having a DOC and a DPF, while the other has only a DPF, it is expected that the system having a DOC and a DPF would, therefore, have a lower filter L/R ratio and thus have a higher PN slip than the system having only the DPF.

Figure 8:
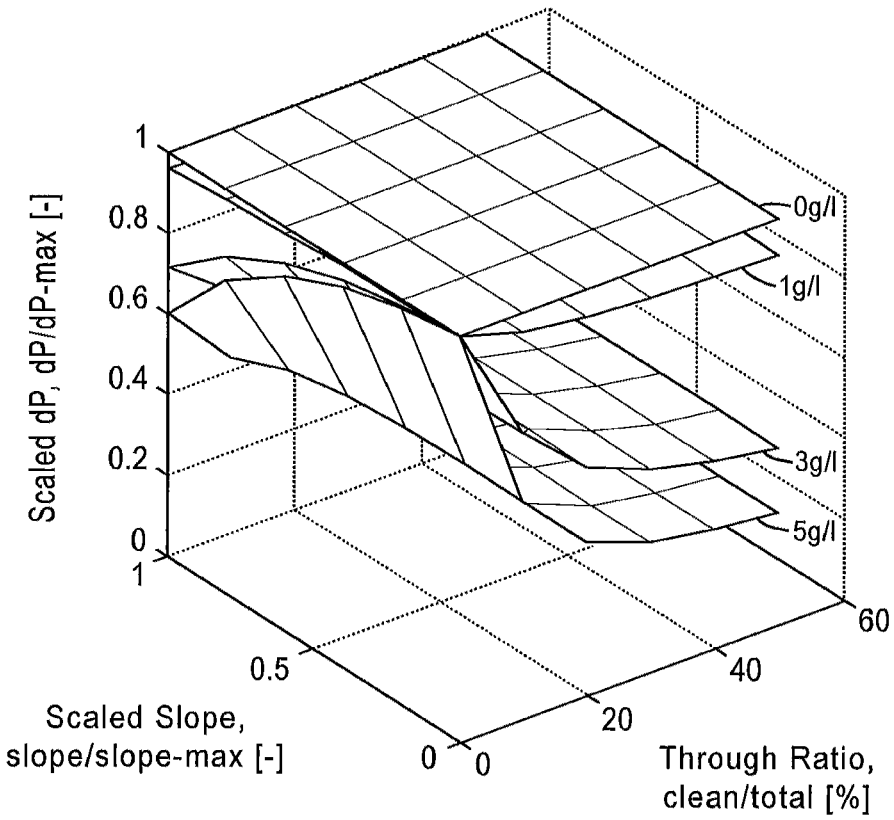
FIG. 8 shows a three-dimensional plot of scaled filter pressure drop (scaled dP) as a function of filter through ratio and scaled soot cake layer slope.

As illustrated in FIGS. 7 and 8, to demonstrate a pressure drop based control method in accordance with the present teachings, a three-dimensional plot was created to evaluate and derive a $dP_{min}$ value. As above, $dP_{min}$ is a function of soot distribution and soot cake permeability, and can be provided through a look up table or through online estimation. For exemplary purposes, with reference to FIGS. 7 and 8, $dP_{min}$ was derived in the following manner.

For simplicity, ash loading, ash distribution, and ash permeability changes were considered negligible. FIG. 7, for example, shows a simplified one-dimensional model of soot distribution within a flow channel 70 having a diameter d and a total channel length L. The flow channel 70 is defined by channel walls 71 having a thickness wt. As shown in FIG. 7, the flow channel 70 has a plug 72 at one end, thereby forcing exhaust gas E to pass through the channel wall 71. As illustrated in FIG. 7, soot cake 73 on the channel wall 71 was considered to be trapezoidal, with an empty wall length l (i.e., a length of wall without soot cake 73) and a wall thickness wt. Accordingly, as above, a through ratio (TR) was defined as the ratio of a channel's filtration surface dependent solely on depth filtration. In other words, TR was defined as the ratio of empty wall length/total channel length (l/L).

Accordingly, as would be understood by those of ordinary skill in the art, to derive a pressure drop corresponding to a minimum soot load of the particulate filter that maintains a soot cake layer along substantially the entire length (L) of the filter ($dP_{min}$), a scaled pressure drop was projected out for a specific filter soot load, as described below.

Pressure and velocity fields in both inlet and outlet flow channels were derived simultaneously, for example, by solving boundary problems using mass and momentum balance equations on both the inlet and outlet flow channels, incorporating Darcy's law to derive a velocity across the wall. Along a channel z direction, for example, a set of ordinary differential equations was set up through mass and momentum balance for the inlet and outlet channels on velocity (u_in, u_out) and pressure (p_in, p_out), as shown below:

$$\frac{du_{in}}{dz} = Au_w$$

$$\frac{du_{out}}{dz} = Bu_w$$

$$\frac{dp_{in}}{dz} = Cu_w u_{in} + Du_{in}$$

$$\frac{dp_{out}}{dz} = Eu_w u_{out} + Fu_{out}$$

wherein the boundary conditioned were defined as:

$$\text{Inlet: } u_{in}=u_{in,BC};u_{out}=0$$

$$\text{Outlet: } u_{in}=0;p_{out}=p_{out,BC}$$

and the velocity across the wall (u_w) was solved by Darcy's law locally as:

$$u_w = -G + \sqrt{(G)^2 + \frac{p_{in} - p_{out}}{H}}$$

As used herein, BC is a boundary condition, and A, B, C, D, E, F, G, and H are parameters derived from filter channel geometry, ash/soot distribution, permeability, and other physical parameters.

FIG. 8 illustrates the solved minimum pressure drop ($dP_{min}$). In FIG. 8, for example, the z-coordinate is a scaled pressure drop (scaled dP), defined as the dP divided by a max dP (i.e., the dP generated by an evenly distributed soot cake) ($dP/dP_{max}$). The y-coordinate is a scaled slope (SS), defined, as above, as the slope of the soot cake distribution profile divided by the max possible slope (d/[2(L=l)]), and the x-coordinate is the TR. As shown in FIG. 8, as TR went up, scaled dP decreased quickly, especially under high soot load conditions, whereas SS had less of an impact. When compared to an evenly distributed soot load, $dP_{min}$ was, for example, 95% for 1 g/l, 70% for 3 g/l, and 60% for 5 g/l soot load. Thus, as long as the dP at an estimated soot load was lower than $dP_{min}$, a soot cake deficiency was detected.

Accordingly, as shown in equation [2], maintaining a soot cake layer along substantially the entire length (L) of the filter suggested having no through areas (i.e., TR=0) and a soot cake distribution having the max possible slope (i.e., SS=1). Those of ordinary skill in the art would therefore understand that $dP_{min}$ can vary with filter design (e.g., geometry and material mean pore size), and that the above derivation is exemplary only and specific to a particular DPF.

Thus, the methods illustrated above with regard to FIGS. 5-8 demonstrate how to control the operation of a particulate filter to maintain an L/R ratio and/or a $dP_{min}$ at a value above a predetermined threshold value. Accordingly, methods for controlling the operating of a particulate filter in accordance with the present teachings can be implemented to maintain filter particle number slip below a predetermined threshold. Those having ordinary skill in the art would understand that the operating conditions described above and the engine cycles used for the studies are exemplary only and other operating conditions and/or engine cycles may be chosen depending on various factors without departing from the present teachings.

Although various exemplary embodiments shown and described herein relate to methods for controlling the operation of a particulate filter used in an automobile exhaust gas treatment system, those having ordinary skill in the art would understand that the methodology described may have a broad range of application to particulate filters useful in a variety of applications, including, but not limited to, coal combustion processes, various other internal combustion engines, stationary and non-stationary, and other particulate filtration applications for which controlling filter operating conditions to maintain filter PN slip below a predetermined threshold is desired. Ordinarily skill artisans would understand how to modify the exemplary methods described herein to control the operating conditions of a particulate filter used in an application other than an automotive application.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the invention has been described in detail with respect to certain exemplary embodiments thereof, it should not be considered limited to such, as numerous modifications are possible without departing from the broad scope of the appended claims.

We claim:

1. A method of controlling the operation of a particulate filter in an exhaust gas after-treatment system, the method comprising:

calculating a ratio of particulate loading rate to filter regeneration rate using a mass-based soot load estimation scheme;

comparing the ratio of particulate loading rate to filter regeneration rate to a predetermined threshold value; and controlling operating conditions of the particulate filter to maintain the ratio of particulate loading rate to filter regeneration rate at a value above the predetermined threshold value.

2. The method of claim 1, wherein the mass-based soot load estimation scheme estimates the soot load based on a filter ash load, a filter temperature, a $NO_2$/NOx ratio, a NOx concentration, a particulate matter concentration, an elementary carbon/organic carbon (EC/OC) split, an exhaust gas mass flow rate, and an $O_2$ concentration.

3. The method of claim 1, wherein calculating a ratio of particulate loading rate to filter regeneration rate comprises calculating a ratio of soot loading rate to filter regeneration rate.

4. The method of claim 1, wherein comparing the ratio of particulate loading rate to filter regeneration rate to a predetermined threshold value comprises comparing the ratio of particulate loading rate to filter regeneration rate to a minimum ratio of particulate loading rate to filter regeneration rate to maintain a soot cake layer along substantially the entire length of the particulate filter.

5. The method of claim 1, wherein controlling operating conditions of the particulate filter comprises adjusting one or more of the operating conditions to increase the ratio of particulate loading rate to filter regeneration rate when the calculated ratio of particulate loading rate to filter regeneration rate is less than or equal to the threshold value.

6. The method of claim 5, wherein adjusting one or more of the operating conditions of the particulate filter comprises changing an engine map to adjust an engine output.

7. The method of claim 6, wherein changing an engine map comprises changing a NOx/particulate matter/temperature map.

8. The method of claim 1, wherein controlling operating conditions of the particulate filter comprises controlling the operating conditions to maintain a particle number slip from the filter below a predetermined threshold.

9. The method of claim 8, wherein the particle number slip corresponds to a number of particles emitted from the particulate filter.

10. The method of claim 1, further comprising:

measuring a pressure drop across the particulate filter;

comparing the measured pressure drop to an estimated minimum pressure drop; and controlling the operating conditions of the particulate filter to maintain the measured pressure drop at a value above the estimated minimum pressure drop, wherein the estimated minimum pressure drop comprises a pressure drop corresponding to a minimum soot load of the particulate filter that maintains a soot cake layer along substantially the entire length of the particulate filter.

11. A method of controlling the operation of a particulate filter in an exhaust gas after-treatment system, the method comprising:

measuring a pressure drop across the particulate filter;

comparing the measured pressure drop to an estimated minimum pressure drop; and controlling operating conditions of the particulate filter to maintain the measured pressure drop at a value above the estimated minimum pressure drop, wherein the estimated minimum pressure drop is a pressure drop corresponding to a minimum soot load of the particulate filter that maintains a soot cake layer along substantially the entire length of the particulate filter.

12. The method of claim 11, further comprising estimating a soot load of the particulate filter to determine the estimated minimum pressure drop.

13. The method of claim 12, wherein estimating a soot load of the particulate filter comprises at least one of estimating a mass-based soot load and estimating a pressure drop-based soot load.

14. The method of claim 11, wherein controlling operating conditions of the particulate filter comprises adjusting one or more of the operating conditions to increase a ratio of particulate loading rate to filter regeneration rate when the measured pressure drop is less than the estimated minimum pressure drop.

15. The method of claim 14, wherein adjusting one or more of the operating conditions of the particulate filter comprises changing an engine map to adjust an engine output.

16. The method of claim 15, wherein changing an engine map comprises changing a NOx/particulate matter/temperature map.

17. The method of claim 11, wherein controlling operating conditions of the particulate filter comprises controlling the operating conditions to maintain a particle number slip from the filter below a predetermined threshold.

18. The method of claim 17, wherein the particle number slip corresponds to a number of particles emitted from the particulate filter.

* * * * *